US008814968B2

(12) United States Patent
Jiang et al.

(10) Patent No.: US 8,814,968 B2
(45) Date of Patent: Aug. 26, 2014

(54) THERMALLY CONDUCTIVE SAND MOULD SHELL FOR MANUFACTURING A MATRIX BIT

(75) Inventors: Alan Honggen Jiang, Gloucester (GB); Harold Sreshta, Conroe, TX (US)

(73) Assignee: National Oilwell Varco, L.P., Houston, TX (US)

( * ) Notice: Subject to any disclaimer, the term of this patent is extended or adjusted under 35 U.S.C. 154(b) by 674 days.

(21) Appl. No.: 13/005,869

(22) Filed: Jan. 13, 2011

(65) Prior Publication Data

US 2011/0167734 A1 Jul. 14, 2011

Related U.S. Application Data

(60) Provisional application No. 61/294,897, filed on Jan. 14, 2010.

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |
| ***B24D 3/02*** | (2006.01) |
| ***C09C 1/68*** | (2006.01) |
| ***B22C 9/02*** | (2006.01) |
| ***C22C 26/00*** | (2006.01) |
| ***E21B 10/00*** | (2006.01) |
| *C22C 1/10* | (2006.01) |

(52) U.S. Cl.

CPC ..... *E21B 10/00* (2013.01); *C22C 2001/1073* (2013.01); *B22C 9/02* (2013.01); *C22C 26/00* (2013.01)

USPC ..... 51/309; 51/293; 51/307

(58) Field of Classification Search

USPC ..... 51/293, 309, 307

See application file for complete search history.

(56) References Cited

U.S. PATENT DOCUMENTS

| | | | | | |
|---|---|---|---|---|---|
| 4,944,817 | A | * | 7/1990 | Bourell et al. | 264/497 |
| 5,031,483 | A | * | 7/1991 | Weaver | 76/107.1 |
| 5,088,047 | A | * | 2/1992 | Bynum | 700/182 |
| 5,433,280 | A | * | 7/1995 | Smith | 175/336 |
| 5,544,550 | A | * | 8/1996 | Smith | 76/108.2 |
| 5,839,329 | A | * | 11/1998 | Smith et al. | 76/108.2 |
| 5,957,006 | A | | 9/1999 | Smith | |
| 6,200,514 | B1 | | 3/2001 | Meister | |
| 6,209,420 | B1 | | 4/2001 | Butcher et al. | |
| 6,353,771 | B1 | | 3/2002 | Southland | |
| 6,454,030 | B1 | | 9/2002 | Findley et al. | |
| 6,655,481 | B2 | | 12/2003 | Findley et al. | |
| 2007/0277651 | A1 | | 12/2007 | Calnan et al. | |
| 2008/0028891 | A1 | * | 2/2008 | Calnan et al. | 76/108.4 |

FOREIGN PATENT DOCUMENTS

| | | |
|---|---|---|
| EP | 0606627 | 7/1994 |
| GB | 2315452 A1 | 10/2002 |
| WO | 9208567 | 5/1992 |
| WO | 9611117 | 4/1996 |

OTHER PUBLICATIONS

GB Search Report from GB Application No. 9715438.9 US2011/030004, dated Dec. 23 , 2011, 1 page.

* cited by examiner

*Primary Examiner* — James McDonough

(74) *Attorney, Agent, or Firm* — JL Salazar Law Firm

(57) ABSTRACT

A thermally conductive sand shell molding system allows for controlling heat flow in a molten metal infiltrate powdered metal drill bit molding system to differentially cool the mold system to control differential shrinking and accompanying stress concentrations.

34 Claims, 4 Drawing Sheets

THERMALLY CONDUCTIVE SAND MOULD SHELL FOR MANUFACTURING A MATRIX BIT

This application claims priority from U.S. Provisional Patent application Ser. No. 61/294,897 filed on Jan. 14, 2010, and is hereby incorporated by reference for all it contains.

BACKGROUND OF THE INVENTION

1. Field of the Invention

Disclosed herein is a rotary earth boring drill bit and the method of manufacture of such a bit, and in particular, a rotary fixed cutter drill bit suitable for use in drilling boreholes into the earth for oil and/or gas exploration and production.

Earth boring drill bits are well known and used for drilling through earthen formations for mineral exploration and extraction, and in particular hydrocarbons. One particular type of earth boring drill bit has an infiltrated metal matrix body. This type of drill bit may be manufactured by packing a mould that has a negative pattern of the bit form with metal powder, such as tungsten carbide powder, around a metal (typically steel) blank. This assembly is then infiltrated with a molten binding alloy in a high temperature furnace process.

For each design of a drill bit, a mould must be built for forming the body of the bit. Then the blank may typically be suspended in the mould, as the metal powders are added. The assembly is then typically furnaced until the mass reaches a fairly uniform temperature of greater than about 1900 F in its center, which causes the metal binder to melt. Upon cooling, the metal binder solidifies, fusing the assembly into a sold mass. Upon cooling, the metal pin section may be threaded for attachment to a drill string.

Conventionally, a bit mould may be fabricated by machining hard graphite material, or pressing soft mud (Graphite/clay) material in a graphite pot using a pattern. Another method for manufacturing a bit mould is to employ direct layered manufacture techniques. In the operation, the layered manufacturing equipment sinters or otherwise secures a first layer of particles of mould material together, disposes a second layer of particles over the first layer, sinters particles in selected regions of the second layer together and to the first layer, and repeats this process to fabricate subsequent layers until the mould has been formed from the mould material particles.

Other known methods for manufacturing fixed cutter drill bits include machining the bit bodies from steel (or other metallic) blanks. Rather than a matrix type bit body with impregnated diamond grains, a solid metallic bit body may be machined from one of more blocks of metal, preferably steel, and a series of cutting elements may be mounted upon the bit's body. As described above, such cutting elements may take the form of polycrystalline diamond compact cutters in which a table of polycrystalline diamond is bonded to a substrate of less hard material, for example tungsten carbide, which, in turn, is mounted upon the steel bit body.

2. Description of the Related Art

Known layered manufacture techniques for making sand moulds include inject glue printing technology and laser sintering technology. The printing technique selectively dispenses the resin in the layered sand material. The activator contained in the sand hardens the binder and realizes the object one layer at a time from bottom to top. In the laser sintering process, the laser selectively sinters coated sand material by scanning cross-sections generated from a CAD file on the surface of a process platform. After each cross-section is scanned, the platform is lowered by one layer thickness, a new layer of material is applied on top, and the process is repeated until the part is completed.

U.S. Pat. No. 6,353,771 and GB Patent application 231545 claim a method to use a layering device to build a mould for a drill bit using solid and conventional sand moulds. The present invention is drawn to a thin wall, hollow and fill type of mould with high thermal conductive material sand mould. This type of sand mould increases heating rates during infiltration process and direction solidification during cooling reducing the propensity for casting defects such a macro and micro porosity and blank-matrix disbond. The high thermal conductive sand mould shell essentially permits the fabrication of matrix bit body with a casting quality that is superior to convention printed sand molds.

BRIEF SUMMARY OF THE INVENTION

This invention relates to method for manufacturing a highly thermal conductive sand mould shell or sand mould components which are used to form matrix drill bits. A 3-dimensional solid model of the mould or mould components are designed using a computer aided design (CAD) system. A layering device divides the solid model in thin cross-section layers revealing a cross-sectional area. Layered manufacturing equipment is used to trace a layer area of mould material such as sand with the same thickness as that of a corresponding divided layer, and sinters or otherwise secures the mould material layer area. The layered manufacturing device proceeds to build the mould shell or mould component layer by layer.

The present invention employs layering manufacturing techniques to fabricate a novel hollow mould shell or a hollow mould component which is different than solid sand moulds or components. The hollow area is filled with graphite composites or other high conductive materials. The mould surface in contact with the hard matrix powder may be coated with a ceramic based slurry to improve as-cast surface finish. The thickness of the mould shell is minimized to reduce the sand thermal barrier of the shell. Minimum thickness is dependent on sand shell preform strength for a given type of resin coated sand and mould sizes. In addition, cooling conductors 112 that have even higher thermal conductivity than the mould shell may be selectively used to further move heat selectively out of the mould. This sand mould shell or component will be then placed in a graphite mould pot for manufacturing a matrix bit.

The present invention discloses a drill bit having:

a) A hollow sand shell instead of solid sand mould components;

b) Hollow sand printed shell filled with highly conductive materials;

c) Improved heading rate during infiltration and improved axial direction cooling rates during cooling d) Improved as-cast quality of a matrix bit.

DETAILED DESCRIPTION OF THE INVENTION

Figure 1:
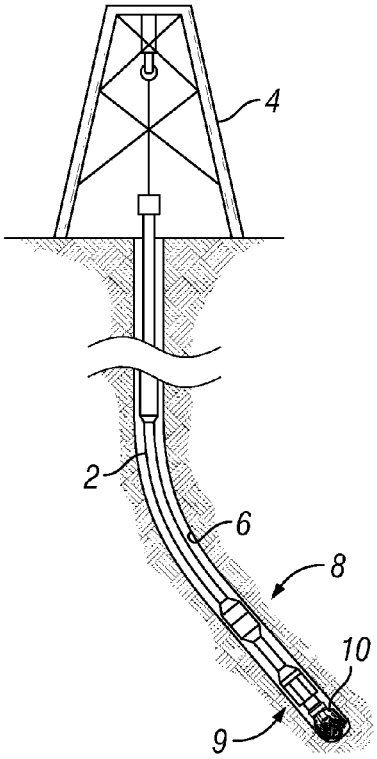
FIG. 1 is a partial cut-away view of a drill rig drilling a borehole into the earth with a drill rig.
Figure 2:
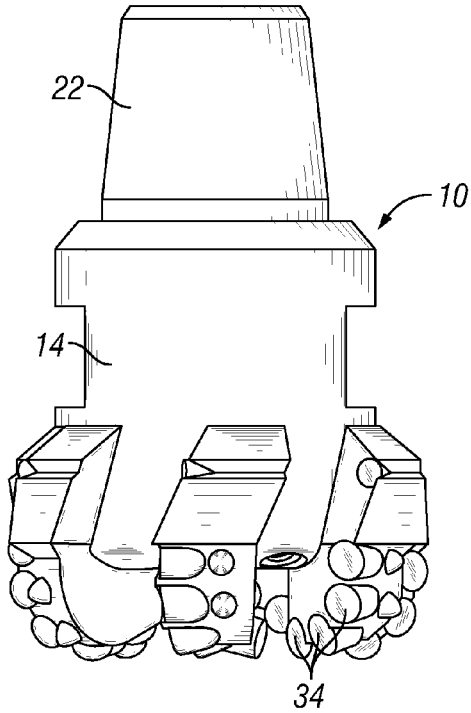
FIG. 2 is a side view of a typical fixed cutter-type drill bit which may be made by the method of the present invention.
Figure 3:
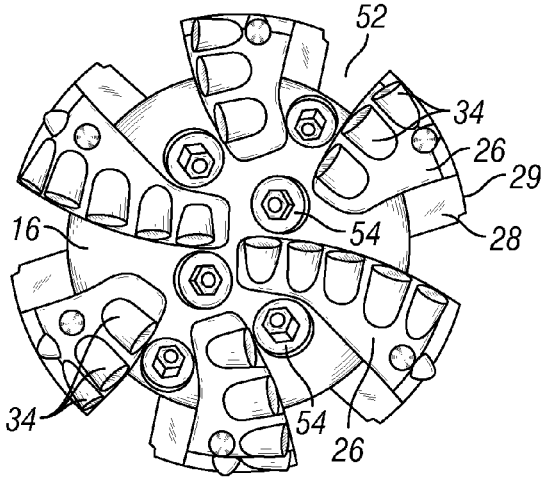
FIG. 3 is a top view of the typical fixed cutter-type drill bit of FIG. 2.

FIG. 1 shows a drill string 2 suspended by a derrick 4 for directionally drilling a borehole 6 into the earth for minerals exploration and recovery, and in particular petroleum. A bottom-hole assembly (BHA) 8 is located at the bottom of the borehole 6. In directional drilling, the BHA 8 may have a downhole steerable drilling system 9 and may comprise a drill bit 10 having a leading face 12 and a gauge region 14.

As the drill bit 10 rotates downhole, it cuts into the earth allowing the drill string 2 to advance, forming the borehole 6. For the purpose of understanding how these systems may be operated, for the type of steerable drilling system 9 illustrated in FIG. 1, the drill bit 10 may be carried by a drive shaft 16 which passes through a housing 18. Within the housing 18, the drive shaft 16 contains a bend such that the output part of the drive shaft 16 is not coaxial with the housing 18, but rather is angled thereto. This is just one of many types and configurations of bottom hole assemblies, however, and is shown only for illustration. The drill bit mould system of the present invention is not limited only to these types of drilling systems, and the invention contemplates that the new mould system may be used for many, varied drilling systems such as coiled tubing, as well as many other drilling and bottom hole assemblies that are well known in the industry.

The drill bit 10 may take a range of forms. In the present invention the drill bit 10 comprises a matrix-type bit body 11 into which cutting elements, for example polycrystalline or single crystal diamond grains are embedded or impregnated, the diamond material serving to abrade the formation material upon rotation of the drill bit 10. These infiltrated bodies may be made in any one of a number of types of moulds. The present invention is drawn to a particular manner of manufacture of these moulds and the method of manufacture of drill bits made with this new infiltrated type of moulding.

In the present invention, the matrix bit body 11 may be shaped to include a series of upstanding blades upon which the cutters are mounted, channels being formed between the blades. In such an arrangement, the bit body 11 may be arranged to include nozzles to allow drilling fluid to be supplied to the channels between the blades for the purposes of cooling and cleaning of the cutters and to carry away from the drill bit material abraded, gouged or otherwise removed from the formation during drilling.

The drill bit 10 has a central axis of rotation 12 and a bit body 14 having a leading face 16, an end face 18, a gauge region 20, and a shank 22 for connection to a drill string. A plurality of blades 26 are upstanding from the leading face 16 of the bit body and extend outwardly away from the central axis of rotation 12 of the bit 10. Each blade 26 terminates in a gauge pad 28 having a gauge surface 29 which faces a wall 30 of the borehole 6.

A number of cutters 34 are mounted on the blades 26 at the end face 18 of the bit 10 in both a cone region 36 and a shoulder region 38 of the end face 18.

Each of the cutters 34 partially protrude from their respective blade 26 and are spaced apart along the blade 26, typically in a given manner to produce a particular type of cutting pattern. Many such patterns exist which may be suitable for use on the drill bit 10 fabricated in accordance with the teachings provided herein.

A cutter 34 typically includes a preform cutting element that is mounted on a carrier in the form of a stud which is secured within a socket in the blade 26. Typically, each preform cutting element is a curvilinear shaped, preferably circular tablet of polycrystalline diamond compact (PDC) or other suitable superhard material bonded to a substrate of tungsten carbide, so that the rear surface of the tungsten carbide substrate may be brazed into a suitably oriented surface on the stud which may also be formed from tungsten carbide.

While the leading face 16 of the drill bit 10 is responsible for cutting the underground formation, the gauge region 20 is generally responsible for stabilizing the drill bit 10 within the borehole 6. The gauge region 20 typically includes extensions of the blades 26 which create channels 52 through which drilling fluid may flow upwardly within the borehole 6 to carry away the cuttings produced by the leading face 16. To facilitate stabilization of the bit without performing a cutting action, the gauge pads 28 are arranged such that the gauge surfaces 29 thereof are devoid of cutters. Although not included in the illustrated embodiment, the gauge surfaces 29 may be provided with means to improve the wear resistance thereof, for example wear resistant inserts or a coating of hard facing material. Such means do not result in the gauge surfaces performing a cutting action but rather simply improve the wear resistance of these parts of the drill bit.

Within the bit body 14 is passaging (not shown) which allows pressurized drilling fluid to be received from the drill string and communicate with one or more orifices 54 located on or adjacent to the leading face 16. These orifices 54 accelerate the drilling fluid in a predetermined direction. The surfaces of the bit body 14 are susceptible to erosive and abrasive wear during the drilling process. A high velocity drilling fluid cleans and cools the cutters 34 and flows along the channels 52, washing the earth cuttings away from the end face 18. The orifices 54 may be formed directly in the bit body 14, or may be incorporated into a replaceable nozzle.

Figure 4:
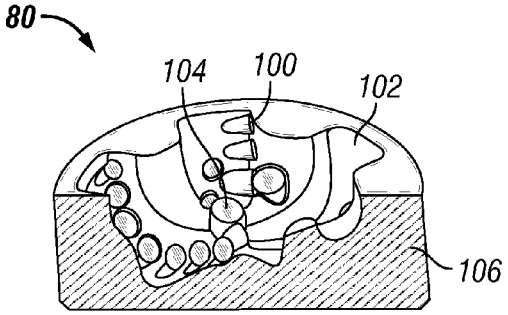
FIG. 4 (Prior Art)
FIGS. 4 and 5 are cutaway perspective views of mould systems of the prior art
Figure 5:
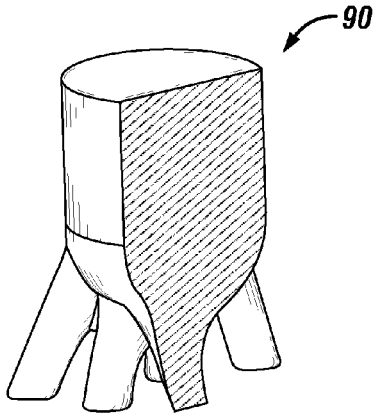
FIG. 5 (Prior Art)

FIGS. 4 and 5 show a typical prior art sand mould shells 80, 90. A 3-dimensional solid model of the mould components are designed using a computer aided design (CAD) system. A layering device such as a selective laser sintering system or an ink printing system may be utilized to fabricate these sand mould components based on the solid models. Bit features such as cutter sockets 100, blade faces 102 and nozzle ports 104 may be formed in the mould material 106.

Figure 6:
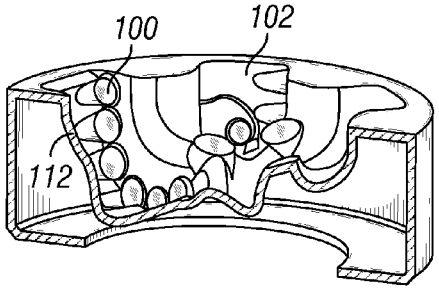
FIGS. 6-12 are several cutaway perspective views of the mould systems of present invention.

FIG. 6 shows various negative form of features 100, 102, 104 which may be formed in a solid cylindrical body 106 of the mould by conventional machine methods.

Figure 7:
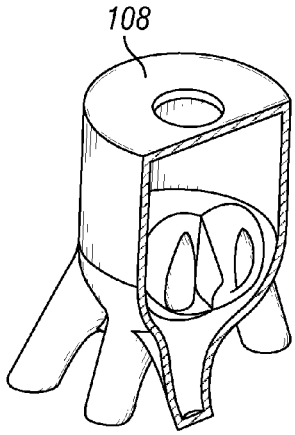
Figure 8:
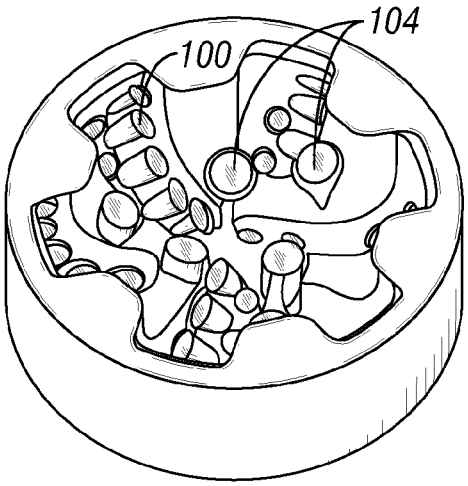
Figure 9:
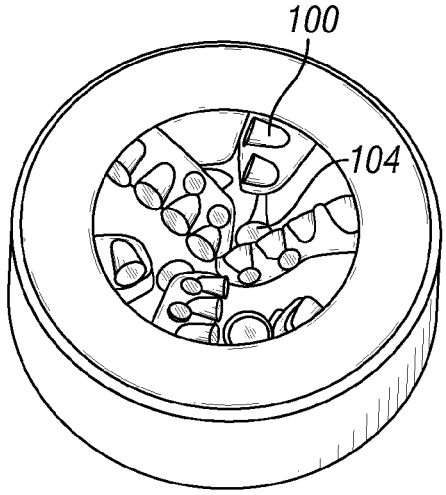
Figure 10:
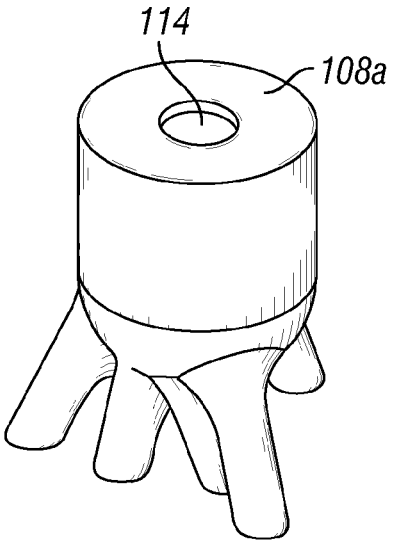
Figure 11:
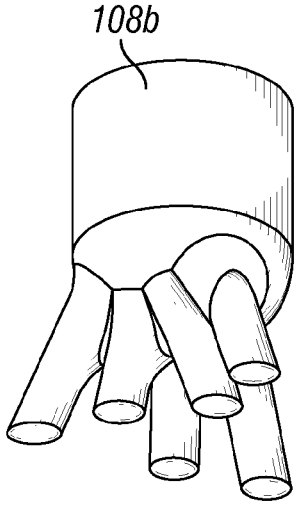
Figure 12:
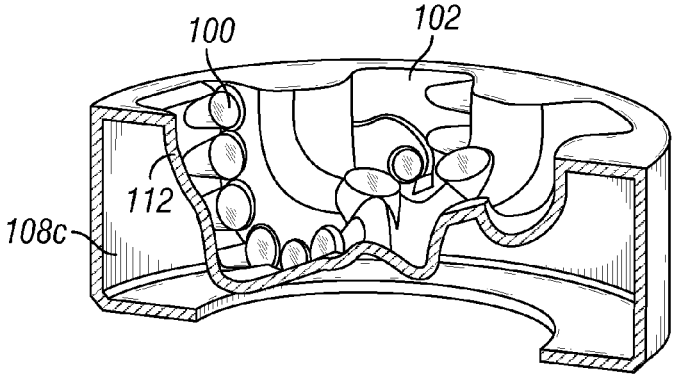

FIG. 7 shows another sample of a hollow component 108 in the form of a Crowfoot Sand Stalk 108*a*, which is one of the mould components in a mould assembly of the present invention. The same methodology as described above may be used to fabricate other hollow sand components similar to 108. These sand components may also preferably be also hollow as shown in FIGS. 6 and 7. Furthermore other various configurations of hollow components (108, 108*a*, 108*b*, 108*c*) may be provided, as shown for example in FIGS. 10-12.

Figure 13:
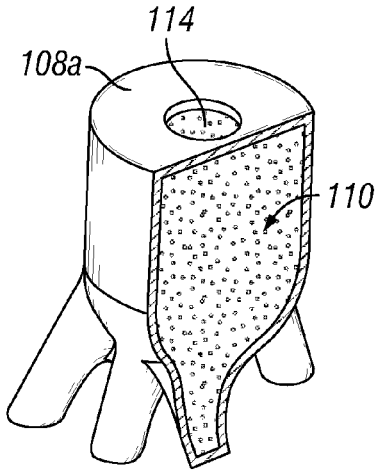
FIGS. 13 and 14 are perspective views of the highly conductive material filling the internal 'crows foot' sand stalk used for forming flushing fluid passages through the body of the drill bit, and also for the face of the drill bit.
Figure 14:
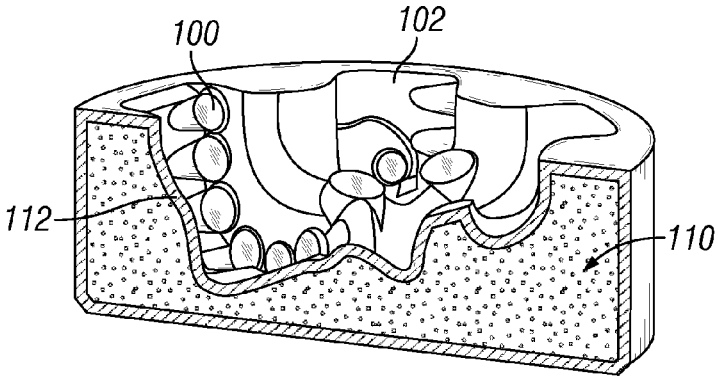

The hollow volumes may be filled with graphite 110 composites or other highly thermal conductive materials as shown in FIGS. 13 and 14 through an access hole 114, or other suitable method.

These sand printed mould or components may have thin walls and are filled with highly thermal conductive materials in the hollow area so that their thermal conductivities are higher than those of solid sand components. These thermal conductive materials may have different thermal conductivities to help the heat to be selectively moved. In this case, additional cooling conductors 112 (in FIGS. 6 & 12) can be located within the walls of the mould to provide selective additional cooling in selected areas. Their thermal conductivities may be adjusted in relation to that of the adjacent thin walls. The sand mould or component fabricated using the methodology disclosed herein will improve heating rate during infiltration and axial direction cooling rate during cooling and solidification of the casting.

The differential cooling provided to the drill bit disclosed herein helps minimize cracking and aids in reducing or eliminating cracking problems that has been known to occur in prior art processes. In additions, this will also improve as-cast physical properties of a matrix bit, such as strength, ductility and impact resistance.

Whereas the present invention has been described in particular relation to the drawings attached hereto, it should be understood that other and further modifications apart from those shown or suggested herein, may be made within the scope and spirit of the present invention.

What is claimed is:

1. A hollow, heated mould assembly for forming a body of an earth boring drill bit by liquid metal infiltration, comprising:

a mould having a hollow body comprising a wall defining an enclosed interior portion and an exterior portion, the wall having an access hole extending therethrough, the body having a uniform thickness with an exterior surface shaped as a negative of the exterior of a profile of the earth boring drill bit, and an exposed interior surface spaced from the exterior surface; and a filler positionable in the enclosed interior of the mould through the access hole, the filler comprising a substance having a specific thermal conductivity to selectively control thermal gradients induced as the mould is cooled and the metal infiltrate solidifies.

2. The mould assembly of claim 1 wherein the mould comprises selected regions with a higher thermal conductivity than other selected regions of the mould with a lower thermal conductivity and thereby inducing thermal gradients in the body as it solidifies.

3. The mould assembly of claim 1 wherein a cooling fluid is selectively applied to areas of the exterior portion of the wall to induce the thermal gradients.

4. The mould assembly of claim 1 wherein the mould comprises a thin wall, hollow and fill type mould comprising a high thermally conductive material sand mould, the sand mould having increased heating rates during infiltration process and directional solidification during cooling thereby reducing the propensity for casting defects, micro porosity and blank/matrix disbond.

5. The mould assembly of claim 1 further comprising additional cooling conductors to further increase thermal conductivity to control the thermal gradients in the body.

6. A method for molding a body of an earth boring drill bit in a liquid metal infiltration process comprising, providing a hollow mold shell of generally uniform thickness having an exterior surface shaped as a negative of the exterior of a profile of an earth boring drill bit, and comprising an exposed interior surface spaced from the exterior surface, the method comprising, filling the exterior surface of the hollow mold shell with a powdered metal and infiltrant;

heating the exterior of the hollow mold shell and infiltrant to a melting temperature of the infiltrant to fuse the powdered metal, while simultaneously cooling the interior of the hollow mold shell, removing the exterior heating while maintaining the cooling, allowing the infiltrant to harden, and breaking the molded bit body out of the hollow mold shell.

7. The method of claim 6 wherein the powdered metal and infiltrant also comprise polycrystalline or single crystal diamond grains.

8. The method of claim 6 wherein the earth boring drill bit comprises a central axis of rotation and a bit body having a leading face, an end face, a gauge region and a shank for connection to a drill string, a plurality of blades are upstanding from the leading face of the bit body and extend outwardly away from a central axis of rotation of the bit and wherein each blade terminates in a gauge pad having a gauge surface which faces a wall of the borehole.

9. The method of claim 8 wherein the matrix bit body is shaped to include a series of upstanding blades upon which the cutters are mounted, and channels being formed between the blades, and the bit body comprising nozzles to allow drilling fluid to be supplied to the channels between the blades during operation for the purposes of cooling and cleaning of the cutters and to carry away from the drill bit material abraded, gouged or otherwise removed from the formation during drilling.

10. The method of claim 8 wherein a cooling fluid is applied to substantially all of the entire interior surfaces of the matrix bit body to induce the thermal gradients.

11. The method of claim 8 further comprising filling the hollow mold shell with graphite.

12. The method of claim 11 wherein the interior surface of the mould forms the exterior of the matrix bit body and wherein the mold comprises a plurality of internal areas each area configured with a plurality of internal surfaces arranged as a negative arranged each surface comprising bit features.

13. The method of claim 11 wherein the interior surface of mould is be shaped to include a series of upstanding blades upon which cutters are mounted, and channels formed between a plurality of blades wherein the bit body is arranged to include nozzles to allow drilling fluid to be supplied to the channels between the blades for the purposes of cooling and cleaning of the cutters and to carry away from the drill bit material abraded, gouged or otherwise removed from the formation during drilling.

14. The method of claim 12 wherein the drill bit has a central axis of rotation and a bit body having a leading face and a shank for connection to a drill string.

15. The method of claim 14 wherein a plurality of blades are upstanding from the leading face of the bit body and extend outwardly away from the central axis of rotation of the bit, and wherein each blade terminates in a gauge pad having a gauge surface which faces a wall of the borehole.

16. The method of claim 15 wherein a number of cutters are mounted on the blades at an end face of the bit in both a cone region and a shoulder region of the end face.

17. The method of claim 16 wherein each of the cutters partially protrude from their respective blade and are spaced apart along the blade to produce a particular type of cutting pattern.

18. The method of claim 17 comprising at least one of the cutters comprising a preform cutting element that is mounted on a carrier in the form of a stud which is secured within a socket in the blade.

19. The method of claim 18 wherein each preform cutting element has a curvilinear shape formed into a tablet of polycrystalline diamond bonded to a substrate of tungsten carbide, so that a rear surface of the tungsten carbide substrate may be brazed into a stud which may also be formed from tungsten carbide.

20. A method for molding a body of an earth boring drill bit in a liquid metal infiltration process comprising, providing a hollow mold shell of generally uniform thickness having an exterior surface shaped as a negative of the exterior of a profile of an earth boring drill bit, and comprising an exposed interior surface spaced from the exterior surface, the method comprising, filling the exterior surface of the hollow mold shell with a powdered metal and infiltrant;

locating cooling conductors within the walls of the mould to provide selective additional cooling in selected areas, heating the exterior of the hollow mold shell and infiltrant to a melting temperature of the infiltrant to fuse the powdered metal, while simultaneously cooling the interior of the hollow mold shell, removing the exterior heating while maintaining the cooling, allowing the infiltrant to harden, and breaking the molded bit body out of the hollow mold shell.

21. The method of claim 20 wherein the bit body comprises passaging which allows pressurized drilling fluid to be received from the drill string and communicate with one or more orifices located on or adjacent to the leading face, the orifices accelerate the drilling fluid in a predetermined direction.

22. The method of claim 21 wherein in operation a high velocity drilling fluid flows from the plurality of orifices on the leading face of the drill bit thereby cleaning and cooling the cutters, and flowing along the channels to wash earth cuttings away from the end face of the drill bit.

23. The method of claim 22 wherein the orifices are formed directly in the bit body.

24. The method of claim 22 wherein the orifices are incorporated into a replaceable nozzle.

25. The mould assembly of claim 1 wherein the body has one of a cylindrical shape and a crowfoot sand stalk shape.

26. The mould assembly of claim 1 wherein the filler comprises graphite.

27. The mould assembly of claim 1 wherein the hollow body has a thermal conductivity greater than the filler.

28. The mould assembly of claim 5 wherein the cooling conductors are positioned in a wall of the hollow body.

29. The mould assembly of claim 1 wherein the body comprises a plurality of layers secured together.

30. The mould assembly of claim 1 further comprising a ceramic coating.

31. The mould assembly of claim 1 wherein the body has differential cooling thereabout.

32. The mould assembly of claim 1 wherein a cooling fluid is applied to substantially all of entire interior surfaces of the body to induce the thermal gradients.

33. The mould assembly of claim 1 wherein the interior portion of the mould forms the exterior of the matrix bit body and wherein the mould comprises a plurality of internal areas each area configured with a plurality of internal surfaces arranged as a negative arranged each surface comprising bit features.

34. A hollow, heated mould assembly for forming a body of an earth boring drill bit by liquid metal infiltration, comprising:

a mould having a hollow body comprising a wall defining an enclosed interior portion and an exterior portion, the wall having an access hole extending therethrough, the hollow body having a thermal conductivity greater than the filler; and a filler positionable in the enclosed interior of the mould through the access hole, the filler comprising a substance having a specific thermal conductivity to selectively control thermal gradients induced as the mould is cooled and the metal infiltrate solidifies.

* * * * *